US005443128A

United States Patent [19]

Amaudric du Chaffaut

[11] Patent Number: 5,443,128

[45] Date of Patent: Aug. 22, 1995

[54] DEVICE FOR REMOTE ACTUATING EQUIPMENT COMPRISING DELAY MEANS

[75] Inventor: Benoît Amaudric du Chaffaut, Voisins le Bretonneux, France

[73] Assignee: Institut Francais du Petrole, Rueil Malmaison, France

[21] Appl. No.: 166,028

[22] Filed: Dec. 14, 1993

[30] Foreign Application Priority Data

Dec. 14, 1992 [FR] France ..... 92 15141

[51] Int. Cl.[6] ..... E21B 44/00

[52] U.S. Cl. ..... 175/25; 175/38; 175/61; 175/75; 175/317; 175/324

[58] Field of Search ..... 175/73–75, 175/25, 38, 48, 61, 256, 317, 324

[56] References Cited

U.S. PATENT DOCUMENTS

| | | | |
|---|---|---|---|
| 3,850,238 | 11/1974 | Hill | 166/314 |
| 4,270,569 | 6/1981 | Reay et al. | 137/514.7 |
| 4,951,760 | 8/1990 | Cendre et al. | 175/269 |
| 5,065,825 | 11/1991 | Bardin et al. | 175/48 X |
| 5,070,950 | 12/1991 | Cendre et al. | 175/74 |
| 5,232,058 | 8/1993 | Morin et al. | 175/74 X |
| 5,273,123 | 12/1993 | Bardin et al. | 175/74 |
| 5,316,093 | 5/1994 | Morin et al. | 175/74 |

FOREIGN PATENT DOCUMENTS

| | | |
|---|---|---|
| 2641320 | 7/1990 | France . |
| 2670824 | 6/1992 | France . |

*Primary Examiner*—Roger J. Schoeppel
*Attorney, Agent, or Firm*—Millen, White, Zelano, & Branigan

[57] ABSTRACT

The present invention relates to a device for remote actuating an equipment through a variation of the flow of a fluid in a pipe. The device includes an adjusting throttle (2, 3; 52, 51) adapted for varying the opening of the passageway of said fluid through a hydrodynamic action. The device further includes delay timing for adjusting the throttle. The present invention further relates to a method for actuating at least one equipment. Application of the device and of the method is to the actuation of equipment adapted for controlling the trajectory of a wellbore.

13 Claims, 6 Drawing Sheets

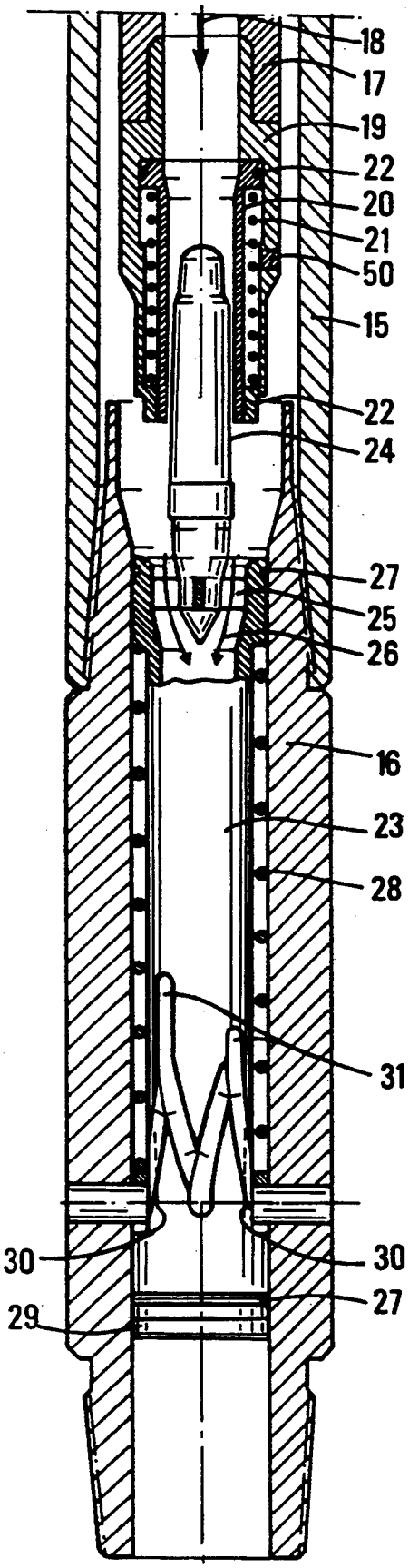
FIG. 1
FIG. 1A
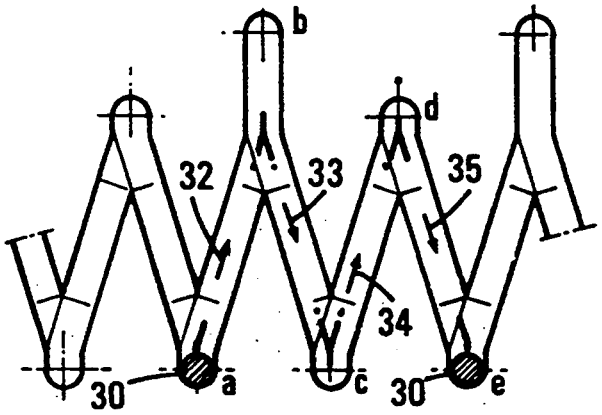

Q
Qf
Qa
Qr
t
t1
t2
t3
t4
t5

Tf1
Tf1
F1
O1
t

Tf2
Tf2
F2
O2
t

P
t

DEVICE FOR REMOTE ACTUATING EQUIPMENT COMPRISING DELAY MEANS

FIELD OF THE INVENTION

The present invention relates to a device and to a method for remote actuating an equipment used in connection with pipes through which a fluid circulates. Actuation is achieved through a variation of the flow of a fluid. The device in accordance with the present invention comprises delay timing means, preferably hydraulic, for timing the means for adjusting the flow of fluid in the pipe.

BACKGROUND OF THE INVENTION

In oil drilling, it is often necessary to remote actuate tools located in a wellbore.

According to the prior art, an annular piston with two faces and a throttle device comprising a needle choke with a variable flow section are used. One face of this piston is subjected to the pressure forces prevailing on one side of the throttle device and the other face is subjected to the pressure forces on the other side of the throttle device.

Generally, the choke is borne by the piston and the needle is set in relation to a pipe containing the assembly and in which the piston may move so as to achieve the desired actuation. The piston includes return means which maintain it in an idle position corresponding to a relatively wide passageway of the throttle device leading to a low pressure drop for the working flow rates.

When the equipment is to be actuated, the rate of flow is increased, which increases the pressure drop on either side of the throttle device, and the piston therefore tends to move by acting against the return means. During this motion, the choke enters the throttle device more and more deeply, hence a greater increase in the pressure drop providing the power for actuating the equipment.

The prior art may be illustrated by Patent FR-2,575,793.

Such a device lacks precision as far as the threshold flow rate initiating the actuation is concerned. In fact, the assembly consisting of the piston and the return spring, which must react to or transmit high powers, cannot be precisely sensitive to a given threshold flow rate, for example because of frictional stresses.

Moreover, this device works through a flow rate increase with respect to the working flow rates. Now, drilling conditions may forbid such a flow rate increase. In fact, the increase due to pressure drops downstream from the device may lead to fracturations in the formation or destabilize the well walls, which might challenge the safety of the operation. On the other hand, a power increase with respect to the power used for drilling is often impossible because the pumping equipment is already prompted at full power for the drilling operation itself.

Patent FR-2,641,320 solves the problem linked to the precision of the threshold flow rate by using a choke or a needle borne by the piston, but mobile with respect to the piston.

This choke or this needle, of a smaller size with respect to the piston and provided with suitable return means, is precisely sensitive to a flow rate threshold, but its main drawback is that the actuation is still initiated by a flow rate increase with respect to the working flow rates.

Patent FR-2,670,824 describes a device allowing these two problems to be solved by using a needle-choke or an equivalent system. This device allows notably the actuation to be initiated from a flow rate threshold less than or equal to the working flow rates, while providing an appreciable activating force such as that necessary for the actuation.

Document FR-2,670,824, filed by the applicant, discloses an actuating device in which a system for sealing partly the fluid passageway is adjusted according to two positions: an actuating position and a position called a drilling position, where no actuation is possible. The adjustment is either remote controlled from the surface or it occupies successively the two positions through the use of an appropriate operational sequence. The drawback of this device is that it requires a complex remote control system and, in the other case, the procedure does not give reliable information on the real position of the seal system.

SUMMARY OF THE INVENTION

The present invention largely solves the drawbacks cited above by using a system for sealing the fluid passageway, which is adjusted through the hydrodynamic action of the fluid. For a given circulation rate, delay timing means maintain a first adjustment, for example an actuation adjustment, for a determined time. Then, under the same conditions, a second adjustment is obtained, for example an adjustment with no activation whatever the flow rate increase. The delay timing means may also control the duration of this adjustment for other determined circulation conditions. The application, from the surface, of determined circulation conditions for a determined time allows the desired adjustment to be selected.

The present invention relates to a device for remote actuating an equipment through a variation of the flow of a fluid in a pipe, comprising coupling means between said device and said equipment to be actuated, adjusting means suited for varying the geometric characteristics of the pasageway of said fluid through the hydrodynamic action of the flow of said fluid in said pipe. The adjusting means comprise delay timing means.

The adjusting means may include return means for adjusting the section of said passageway to a minimum value when the rate of flow is substantially less than a determined flow rate Qr.

The delay timing means may include a hydraulic circuit and a flow regulator.

The value of the flow rate controlled by said flow regulator may be adjustable.

The adjusting means may include an element mounted sliding in the pipe.

Said sliding element may co-operate with a hydraulic system comprising two sealed chambers and the sliding of said element may be adapted for transferring the oil contained in said system from one chamber to the other through said flow regulator.

Said adjusting means may include another element of the choke type co-operating with the coupling means and said sliding element may be of the needle type.

The present invention further relates to a method for remote actuating at least one equipment through a variation of the flow conditions of a fluid in a pipe, said pipe comprising at least means for adjusting the geometric conditions of the passageway of said fluid, between a first adjustment and a second adjustment, said means passing from one adjustment to the second through the hydrodynamic action of the flow generated by a flow rate at least equal to a flow rate value Qr and said means passing from the second adjustment to the first for a flow rate less than Qr. The method comprises the following stages:

- a time Tf during which said adjusting means maintain said first actuation adjustment under the hydrodynamic action of a flow rate at least equal to Qr is adjusted by means of delay timing means,
- a time Tr during which said adjusting means maintain said second adjustment under the hydrodynamic action of a flow rate less than Qr or a null flow rate is adjusted by means of delay timing means.

The method may comprise the following stage:

- a flow at a rate less than flow rate Qr is performed during a time at least equal to Tr so that the adjusting means occupies the first adjustment, and the equipment is actuated by varying the flow in the pipe until a flow rate at least greater than an activation flow rate Qa greater than Qr is obtained, said variation being achieved during a time less than or equal to Tf.

It may also comprise the following stage:

- a flow at a rate at least equal to Qr is performed during a time at least equal to Tf so that the adjusting means occupies the second adjustment, then the circulation rate is increased.

The method in accordance with the invention, in which said pipe comprises two equipments 1 and 2 to be actuated associated each with adjusting means, said adjusting means having respectively Tf1 and Tf2 as a first adjustment maintenance time and Tr1 and Tr2 as a second adjustment maintenance time, Tf1 being less than Tf2, Tr1 being less than Tr2, may comprise the following stages:

a) a circulation at a flow rate at least greater than Qr is performed for a time greater than Tf2 so as to obtain the second adjustment, b) a circulation at a substantially null flow rate or at a flow rate less than Qr is performed for a time greater than Tr2 so as to obtain the first adjustment.

The method may then comprise at least one of the following stages:

- a drilling flow rate Qf greater than Qa is established without activating said equipments and by carrying out stage a) before the flow rate is increased up to Qf,
- equipment 1 is actuated without actuating equipment 2, by carrying out successively stage a), then by decreasing the flow rate to a value less than Qr during a time greater than Tr1 but less than Tr2, then by increasing the flow rate up to a flow rate at least greater than Qa,
- equipment 2 is actuated without actuating equipment 1, by carrying out successively stage b), then by increasing the flow rate up to a value at least equal to Qr during a time greater than Tf1 but less than Tf2, then the flow rate is increased up to a value at least greater than Qa.

The device and the method in accordance with the invention may be applied to the actuation of at least one equipment included in a drill string, such as a remote-controlled variable-geometry stabilizer, a remote-controlled variable-angle bent sub allowing the trajectory of a wellbore to be controlled.

BRIEF DESCRIPTION OF THE DRAWINGS

Other features and advantages of the present invention will be clear from reading the following description given by way of non limitative examples, with reference to the accompanying drawings in which:

FIGS. 1 and 1A illustrate the prior art,

DESCRIPTION OF THE PREFERRED EMBODIMENTS

Figure 2A:
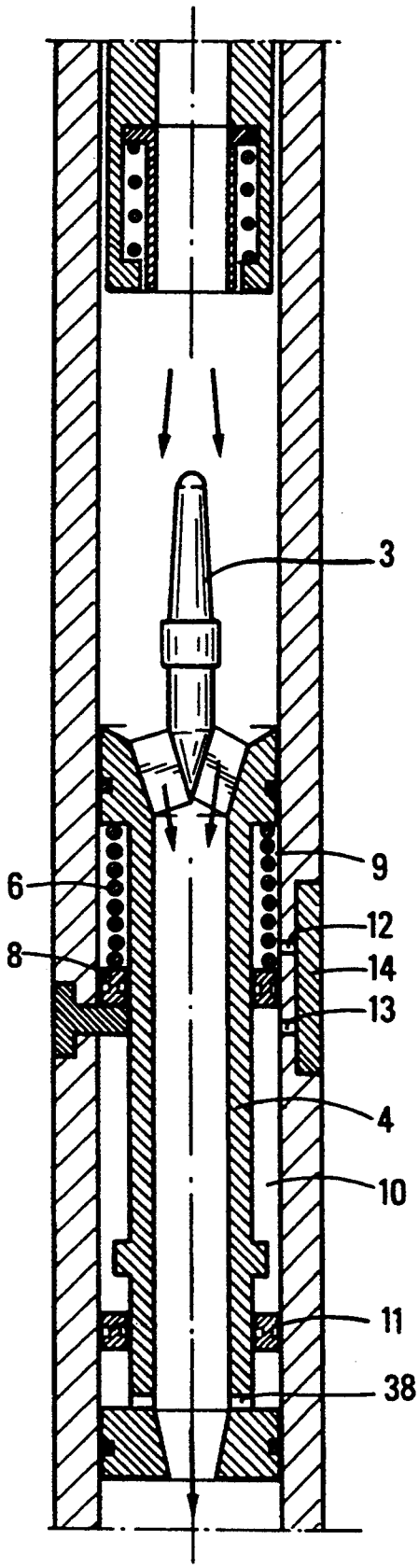
FIGS. 2 and 2A diagrammatically show the adjusting device including a hydraulic delay timer, FIGS. 3, 3A and 3B respectively show, in temporal correspondance, the evolution of the flow rate, of the needle position and of the pressure, FIGS. 4, 4A, 4B and 4C relate to the invention in the case when two equipments are to be actuated. They describe the evolution of the flow rate, of the needle position of the two equipments when one is actuated, and of the upstream pressure, FIGS. 5, 5A, 5B and 5C describe the working conditions when the other equipment is actuated.

FIGS. 1 and 1A illustrate the prior art described in document FR-2,670,824:

The body of the device consists of the assembly of two connections 15 and 16 according to conventional methods. The upper connection 15 contains the actuating shaft 17 which is hollow. The direction of circulation of the fluid corresponds to the direction of arrow 18. The end of shaft 17 bears the assembly consisting of a choke holder 19, a choke 20 and a return spring 21. Seal gaskets 22 complete the assembly. A bidirectional valve 50 allows the pressure between the chamber of spring 20 and the outside to be balanced. Choke 20 thus has the shape of an annular differential-section piston whose largest section is located upstream from the flow.

Lower connection 16 contains a piston 23 with which a needle 24 is secured by means of a crosspiece 25. This crosspiece 25 is adapted for allowing the fluid circulation to pass in the direction of arrows 26. The annular piston 23 includes seals 27 substantially at each end, a return spring 28 and a section restriction 29.

At least one finger 30 co-operates with a groove 31 machined in the body of piston 23. This assembly constitutes in no way a limitative example of the system for adjusting the stroke of piston 23 integral with needle 24.

FIG. 1A is a developped view of said groove borne by piston 23. The groove is continuous over the circumference of the outer surface of piston 23. It consists of a whole number of pitches. The M-shaped trace described by the groove connecting points a, b, c, d and e represents one pitch. Arrows 32, 33, 34 and 35 show the direction of the displacement of finger 30 in said groove when going respectively from a to b, from b to c, from c to d and from d to e. A complete cycle is achieved from a to e. During the sliding displacement of piston 23, the latter undergoes a rotation due to the inclination of each groove portion with respect to the axis of the piston. The direction of displacement of the fingers in the groove is irreversible because of the difference in altitude of the groove bottom between two consecutive vertices.

The rate of circulation in the direction of arrow 18 generates a hydrodynamic force on the assembly consisting of needle 24 and piston 23. This force is adjusted as a function of the passageway restriction 29 located in the piston. When said force is stronger than the force exerted by return spring 28, the piston moves downward until it is stopped, for example, by the finger 30 in groove 31 when said finger is at b. With this adjustment, the sealing of the device is at its minimum level and actuation is impossible.

A decrease in the flow rate makes the needle move upward and finger 30 moves to c (FIG. 1A). A new flow rate increase, sufficient to make the needle move backwards, displaces then finger 30 towards position d. In this adjustment position, the pressure drop generated by an activation flow rate acts upon the actuating piston.

In this document, adjustments are obtained successively by a series of flow variations. Furthermore, after each circulation stop, operators may be uncertain as to the nature of the next adjustment.

The present invention, in accordance with a preferred embodiment, proposes to change the means for controlling the displacement of the needle by substituting a time-delay hydraulic system for the finger (30) and groove (31) system.

Figure 2:
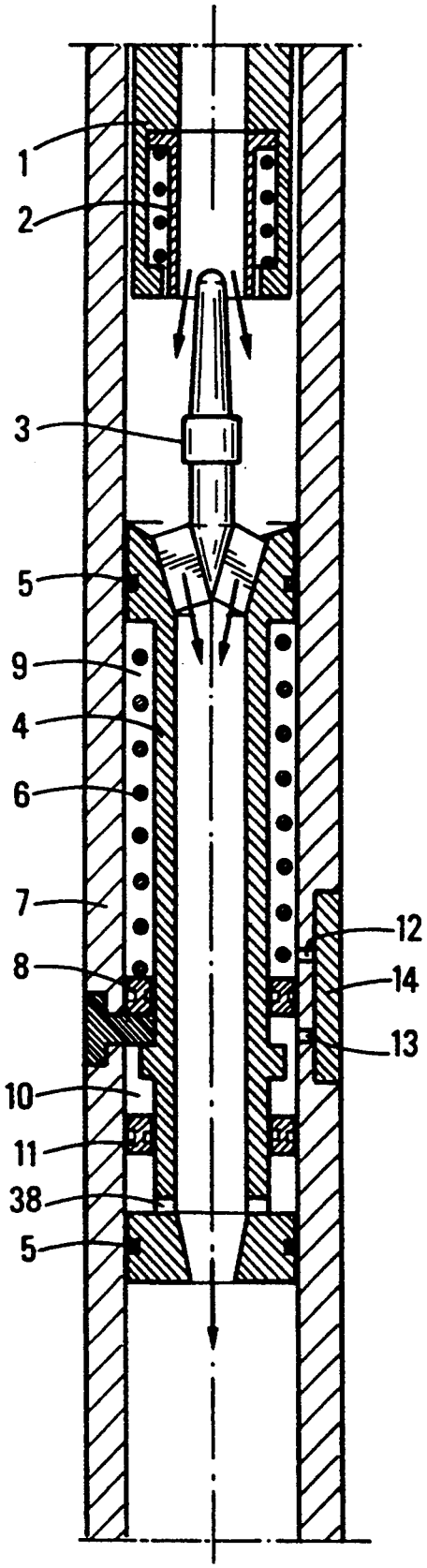

The preferred embodiment is illustrated by FIGS. 2 and 2A. A bean assembly made up of a shaft 1 on which a mobile choke 2 and a needle 3 are mounted controls the more or less large sealing of the fluid passageway. Shaft 1 is coupled hydraulically or mechanically with an equipment to be actuated. The assembly described above is not different from the prior art.

Needle 3 is integral with a shaft 4 which may slide with respect to choke 2 in a body 7. Shaft 4 includes substantially at its two ends seal means 5, delimiting thereby an annular space between the outside of shaft 4 and the inside of body 7. This annular space is divided into several sealed chambers, notably through a partition 8 integral with body 7. These chambers have a variable volume according to the longitudinal motion of the shaft. A volume decrease of one chamber corresponds to a volume increase of the other, for the same value. The sealed chamber 9 communicates with the sealed chamber 10 through pipe 12, flow regulator 14 and pipe 13. These chambers contain a substantially incompressible fluid, for example a hydraulic fluid. The longitudinal displacement of the shaft is conditioned by the transfer of the incompressible fluid from one chamber to the other according to a flow regime controlled by regulator 14.

Chamber 9 includes a return spring 6 whose size is so determined that a reduced flow rate Qr of the fluid circulating in the direction of the arrows generates a hydrodynamic force on shaft 4 which is at least greater than the return force of spring 6, considering also the internal frictions. Thus, for a circulation rate less than Qr, the needle 3 of shaft 4 is in an upper position in choke 2. This position, shown in FIG. 2, is the position of maximum obstruction of the passageway.

A floating annular piston 11 forms a partition of chamber 10. The pressure of the fluid circulating in the pipe is exerted on one face of piston 11 by means of connection pipe 38. The function of the floating piston 11 is to substantially even the pressure of the hydraulic fluid contained in chambers 9 and 10 with the pressure of the fluid circulating in the pipe. Such a balancing system, well-known by the man skilled in the art, may be achieved by other means without departing from the scope of this invention.

FIG. 2A shows the instance where the needle is in a maximum lower position with respect to the choke. In this case, whatever the flow rate increase, there can be no actuation of the equipment. Spring 6 is compressed and the volume of fluid contained in chamber 9 has run into chamber 10 by means of regulator 14.

Regulator 14 is a flow regulator, for example of the 2FRM type manufactured by the REXROTH Company. This regulator is a flow valve having two ways connected to pipes 12 and 13. It allows a fluid flow rate to be controlled independently of the pressure and the temperature. It is mainly made up of a body, an adjusting element, a throttle valve, a pressure balance with or without a nonreturn valve. The throttling of the fluid flow rate is performed on the throttle section of the valve determined by the adjusting element. In order to maintain the flow rate constant independently of the pressure, a pressure balance is mounted behind the throttle section. This type of regulator, well-known by hydraulic engineers, will not be described more in detail. In case the regulator is unidirectional with respect to the flow rate direction, for example a direction of flow from 9 to 10, it is essential to add to the device a second regulator specific to the flow rate from 10 to 9 if the time necessary for the shaft to come back to its starting adjustment is to be controlled. A set of nonreturn valves selects the pipes. These layouts are conventional for regulated hydraulic circuits.

Regulation of the flow rate between chamber 9 and chamber 10 therefore allows the time taken by needle 3 to disengage from the choke through a hydrodynamic force resulting from a circulation at a flow rate at least equal to Qr to be controlled. This means that it is possible to obtain, thanks notably to the elongated shape of the needle, an adjustment of the time Tf during which the sealing of the passageway is sufficient to have an actuation if the flow rate reaches a value Qa or activation flow rate.

After a circulation at a flow rate at least greater than Qr for a time greater than Tf, the operator knows that the needle is in the disengaged position (FIG. 2A). He may then increase the circulation rate without any risk of actuation of said equipment.

In the position of FIG. 2A, when the flow rate is decreased to a value less than Qr, the action of the return spring becomes dominant to bring the needle back to the maximum sealing position. Its return is also conditioned by the flow of the hydraulic fluid contained in chamber 10 towards chamber 9. The time Tr taken by the needle to reach the maximum sealing adjustment may be controlled by placing another regulator, if the first one is not bidirectional, on the communication between 10 and 9. The minimum sealing position may thereby be maintained during the time Tr.

Figure 6A:
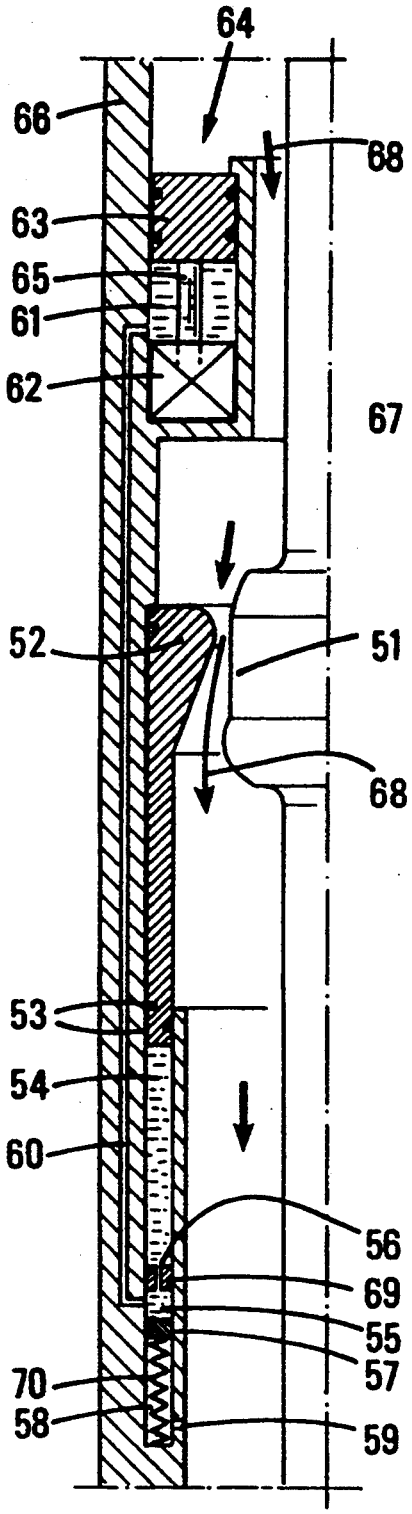
FIGS. 6A and 6B illustrate another embodiment.
Figure 6B:
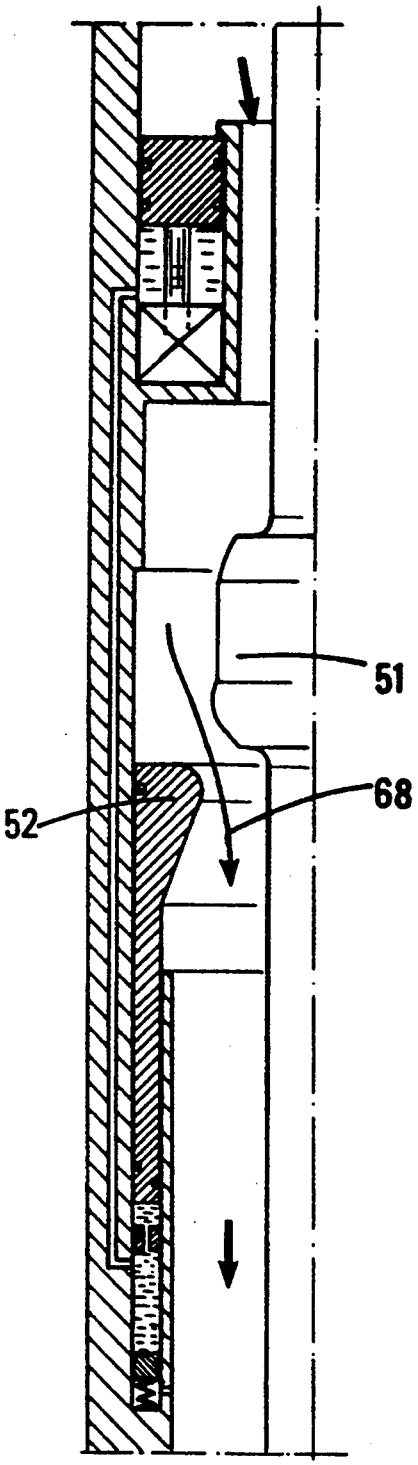

FIGS. 6A and 6B show another embodiment of an actuation device. A pipe 66 contains in its inner channel a shaft 67 defining an annular passageway in which a fluid circulates in the direction of arrows 68. An equipment to be actuated, connected to pipe 66, is symbolized here by assembly 62. The shaft 67 includes a shoulder 51 whose outer shape cooperates with an annular piston 52. The annular piston 52 is mounted sliding in pipe 66. Seal gaskets 53 insulate the chamber 54 from the fluid circulating in the pipe. Chamber 54 is defined by the lower face of piston 52 and by a wall 69 including a flow regulator 56. Another chamber 55 is delimited by wall 69 and by a floating piston 57. The chamber 70 provided in the wall of pipe 66 comprises a spring 58 adapted for pushing the floating piston 57 close towards the wall 69. Chamber 70 communicates through port 59 with the inner channel of the pipe.

An actuating piston 63 co-operates with a transmission 65 to actuate the equipment 62. Piston 63 is subjected on one side to the hydraulic pressure prevailing in space 64, and on the other side to the pressure prevailing in the sealed chamber 61. Chambers 61 and 55 communicate hydraulically through pipe 60.

The working principle of this embodiment is described hereunder. When the circulation of a fluid, for example the drilling fluid, is established in the pipe, a hydrodynamic force generated by the flow restriction between shoulder 51 and piston 52 tends to push the piston back downstream. The hydrodynamic force must be greater than the force necessary to compress spring 58. However, the displacement of piston 52 is controlled by the rate of outflow of the fluid contained in chamber 54 through regulator 56. A suitable adjustment of regulator 56 allows the translation time of the piston to be controlled. As long as the piston faces shoulder 51, the upstream pressure can be increased, particularly in zone 64, by increasing the circulation rate sufficiently. Piston 63 may therefore be subjected to the same differential pressure prevailing upstream and downstream from shoulder 51. In fact, pipe 60 balances the pressure of chamber 61 with chamber 55, whose pressure is also balanced with that of chamber 70 by means of the floating piston 57, apart from the force of return spring 58. In this position, equipment 62 is actuated by piston 63.

The actuation being achieved, circulation of the fluid may be continued in pipe 66 so as to disengage piston 52 from shoulder 51. The section of flow is such then that the differential pressure is too low for piston 63 to actuate equipment 62. The rate of flow may therefore be increased up to the drilling flow rate, for example, to carry on with the operation (FIG. 6B).

If a new actuation is desired, the flow rate has to be reduced so that the hydrodynamic force on piston 52 is such that spring 58 transfers the fluid contained in chamber 55 towards chamber 54. The fluid transfer from chamber 55 to chamber 54 may be achieved in a controlled way through a flow regulator or as directly as possible through a pipe including a nonreturn valve only in the direction of chamber 54 towards chamber 55.

The embodiment in accordance with FIGS. 6A and 6B illustrates the instance where the adjusting means are annular with respect to a shaft 67 contained in the pipe. This shaft may be a drive shaft transmitting a rotation.

Figure 3:
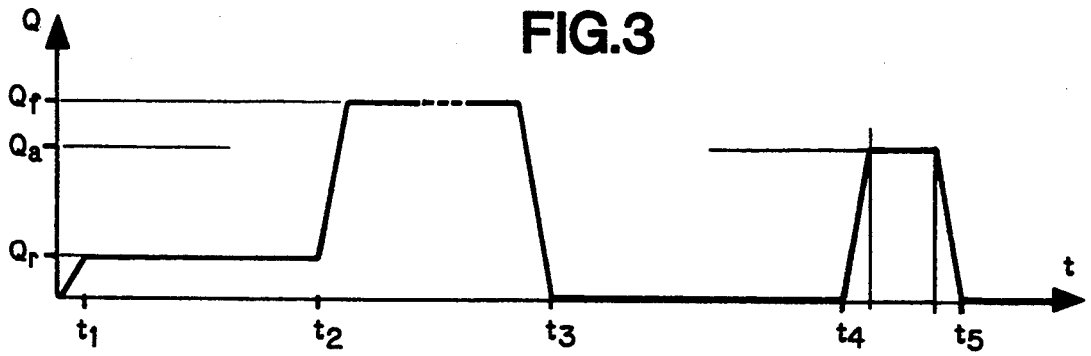
Figure 3A:
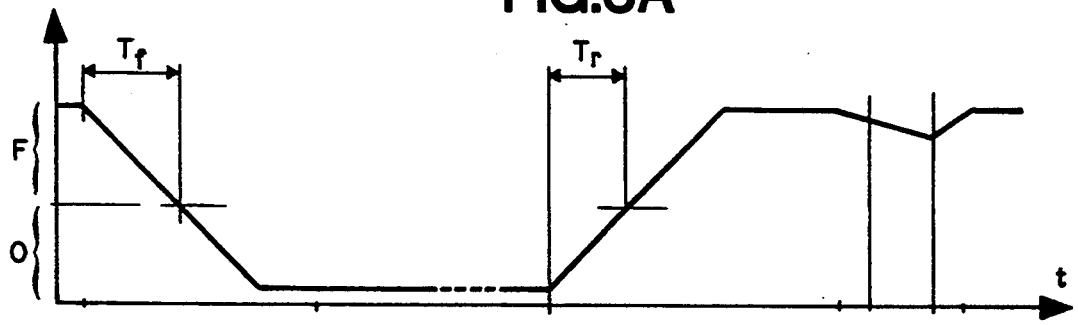
Figure 3B:
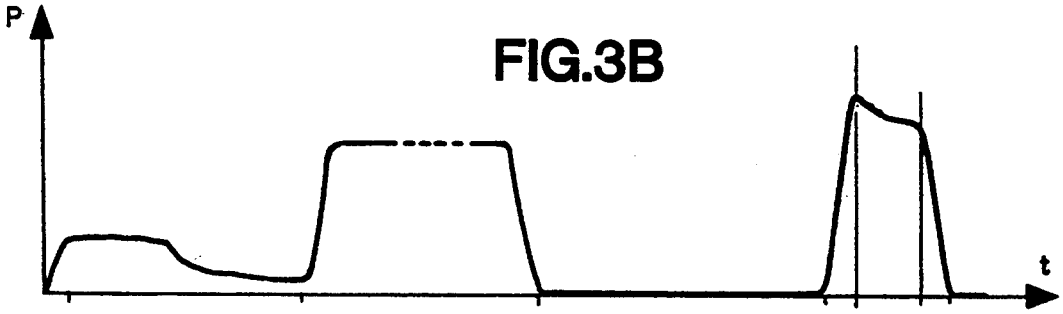

The functions of the device and the evolution of the stages of the method in accordance with the present invention will be clear from reading the description of the procedures illustrated in FIGS. 3, 3A and 3B.

The three FIGS. 3, 3A and 3B are time-dependency diagrams, time being laid off as abscissa. FIG. 3 shows the circulation rate of the fluid circulating in the pipe. The flow rate and its variations are obtained through pumping means generally located at the ground surface. FIG. 3A shows the position of needle 3 with respect to the choke or of piston 52 with respect to shoulder 51. Bracket F shows the positions for which the sealing is at its maximum level, bracket O shows the positions where the sealing is at its minimum level. FIG. 3B shows the evolution of the differential pressure between the upstream side and the downstream side of the needle-choke system, this pressure resulting from the value of the flow rate and from the position of the needle.

At the beginning, the flow rate is zero, the needle is at its maximum level in the choke, the pressure is zero.

At the time t1, the flow rate is established at Qr, the needle moves back under the action of the force generated by the flow rate Qr but it remains during the time Tf within the area F, the pressure decreases until the pressure drop value corresponding to the total recoil of the needle is reached.

At the time t2, such that t2−t1 is greater than Tf, the flow rate is Qr, the needle has moved back at its maximum level. From this time on, an increase in the flow rate up to the drilling flow rate Qf causes no actuation of the equipment. In fact, the pressure drop is not sufficient to generate an actuating force.

The flow rate cycle described above will be repeated by the operator every time he wants to establish the drilling flow rate, without actuation.

At the time t3, the flow rate is zeroed or decreased down to a level less than Qr while the needle is in a recoiled position. The needle moves forward under the action of the return spring, while keeping during a time Tr the adjustment corresponding to the minimum sealing.

At the time t4, such that t4−t3 is greater than Tr, the operator may actuate the equipment by increasing the flow rate up to the actuation flow rate Qa. To that effect, the time t5−t4 must be less than the time Tf. The flow rate Qa is thus established when the adjustment is at F, which leads to a high pressure drop for the actuation (FIG. 3B).

To achieve the actuation or the non-actuation, the operator carries out the flow rate cycles described above from a precise position of needle 3 or of piston 52.

The invention is notably characterized in that the state of the adjustment may be positively known through the following two actions only:

- needle 3 or piston moved forward (F) when the flow rate remains less than Qr during at least a time greater than Tr,
- needle 3 or piston moved backward (O) when the flow rate is established at a value at least equal to Qr during a time at least greater than Tf.

Furthermore, the present invention allows the actuation of two equipments integrated in a pipe. Each equipment has its own adjusting and actuating device. The seal means generate a pressure drop with respect to the upstream and the downstream part of the choke mounted on the shaft of the actuating piston. In case two equipments positioned in series in a pipe are to be actuated, the production of such a pressure drop on the actuating piston of one of the equipments actuates the latter without operating the other since the piston of the second equipment is not subjected to a differential pressure, but only to an increase in the pressure level upstream and downstream from its actuating piston.

FIGS. 4, 4A, 4B and 4C illustrate the procedures for establishing a drilling flow rate Qr without actuating the equipments, or for actuating a first equipment without operating the other.

FIGS. 5, 5A, 5B and 5C illustrate the procedure for actuating the second equipment without operating the first one.

Figure 4:
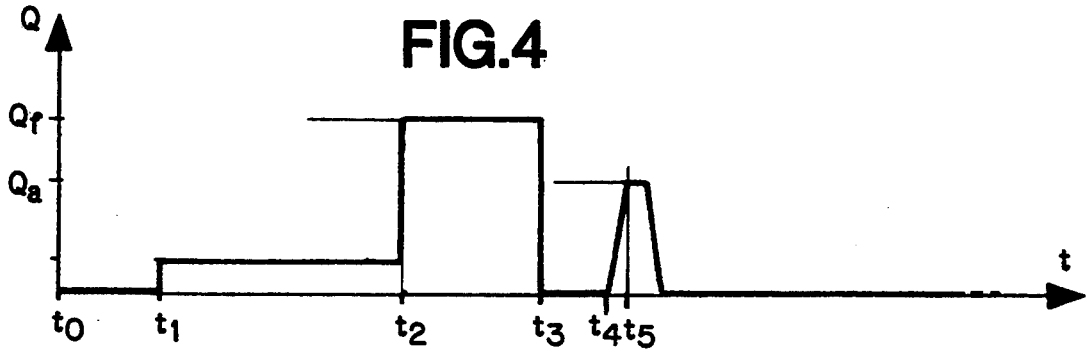
Figure 4A:
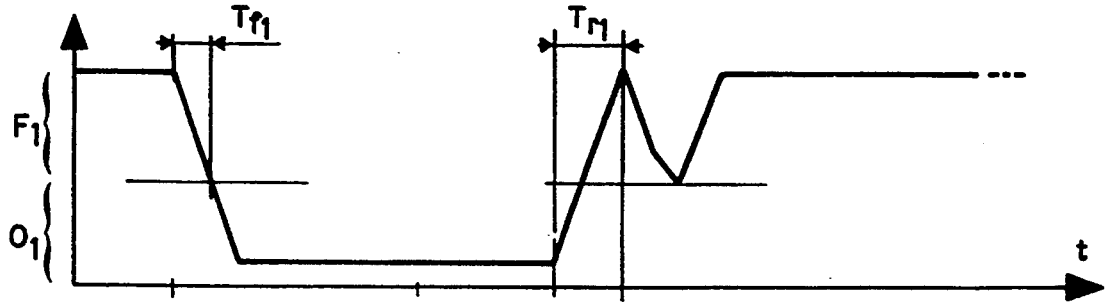
Figure 4B:
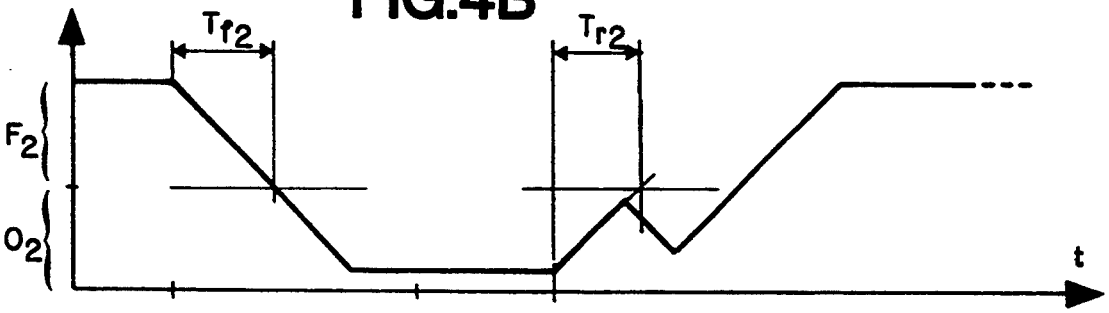
Figure 4C:
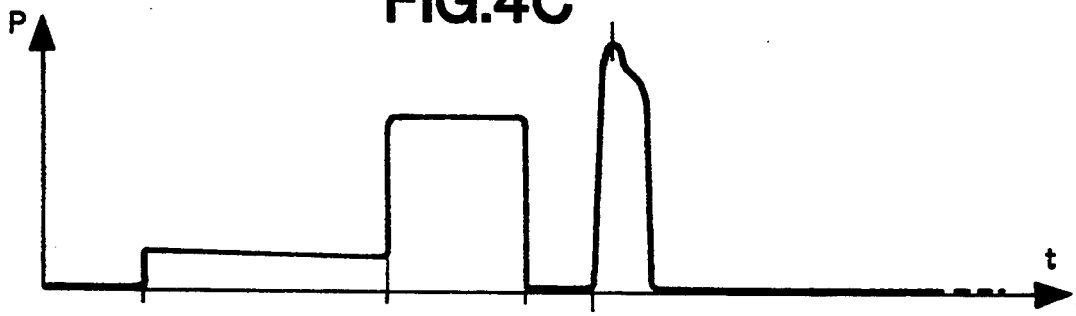
Figure 5:
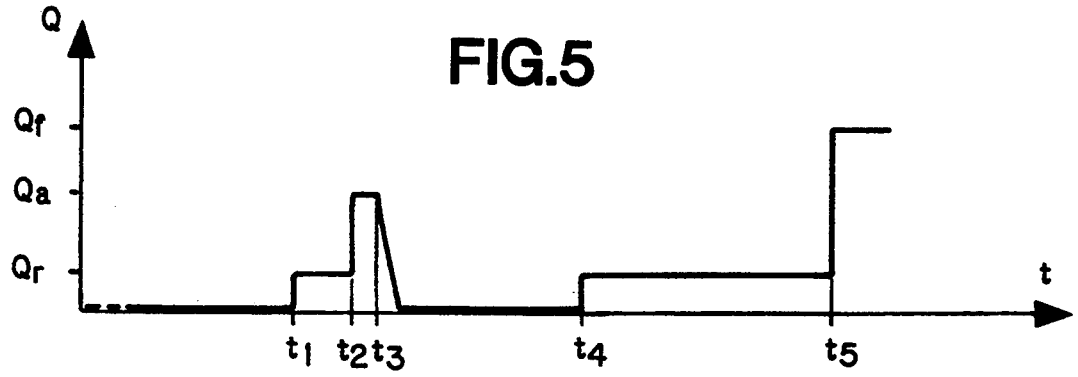
Figure 5A:
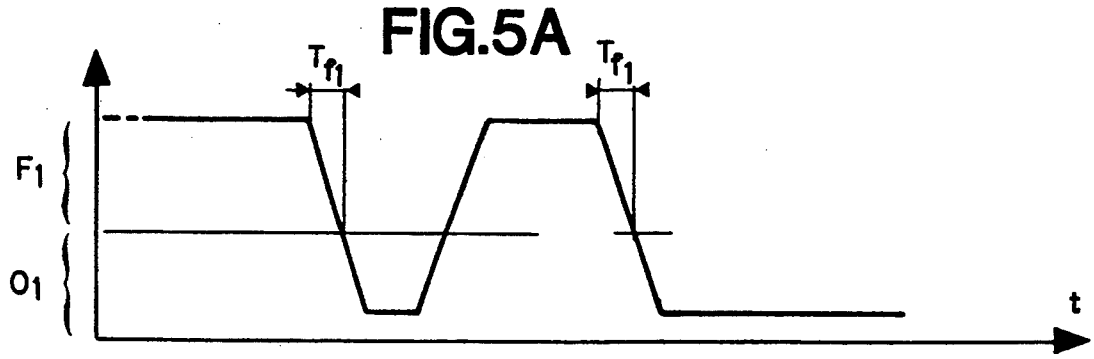
Figure 5B:
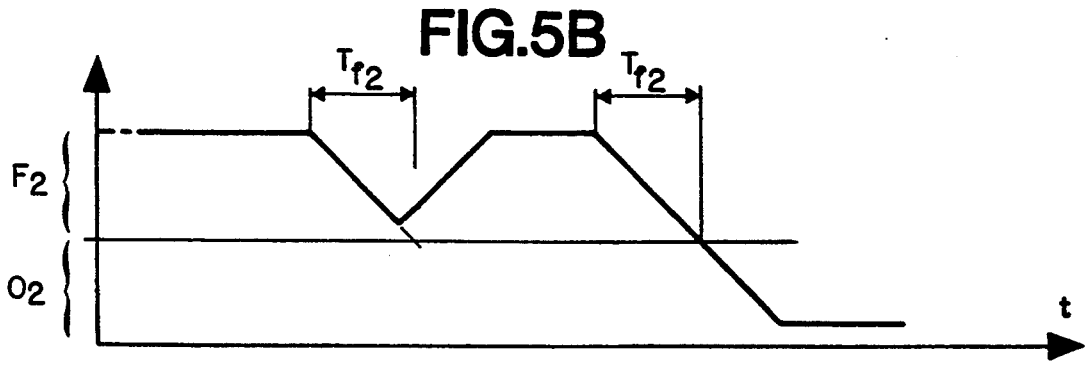
Figure 5C:
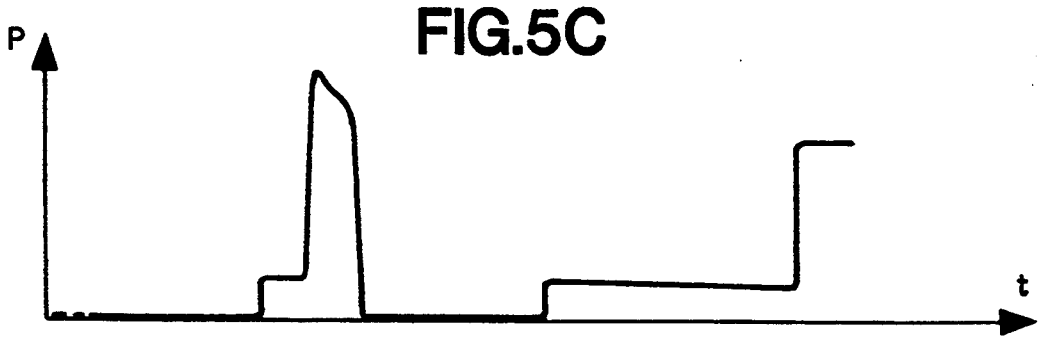

The parameters shown in the diagrams of FIGS. 4 and 5 are the same as those shown in FIG. 3. The diagrams of FIGS. 4A or 5A and 4B or 5B are equivalent to the diagram of FIG. 3A, but for each of the adjusting means of the first and of the second equipment. Indexes A and B respectively refer to the first and to the second equipment.

At the beginning (t0), the flow rate in the pipe is zero or at least less than the flow rate Qr. The adjustments of needles 1 and 2 (FIGS. 4A and 4B) are in the maximum sealing position (F).

At the time t1, the flow rate is increased at least up to Qr, but to a value less than Qa, for a time t2−t1. The needles move backward under the hydrodynamic action of the flow rate. If t2−t1 is greater than Tf2 (Tf2>Tf1), the operator is positively assured that the two adjusting means are at O, i.e. the actuation will not take place when he increases the flow rate, for example to establish the drilling flow rate Qf.

He performs a drilling operation until t3, the time when he wants to actuate equipment 1.

By zeroing the flow rate or by decreasing it to a value less than Qr, the operator causes the needles 1 and 2 to move back to their closed position (F). If he continues this phase for a time greater than Tr1 but less than Tr2, at the time t4 the adjustment of equipment 2 is at O, and the adjustment of equipment 1 is at F. At this time, an increase in the flow rate at least up to value Qa allows the actuation of equipment 1 through the production of a sufficient differential pressure between the upstream side and the downstream side of the means for sealing equipment 1. Of course, the time t5−t4 for establishing the activation flow rate must be less than Tf1. The actuation may be recognized through the surface visual display of the pressure peak shown in FIG. 4C.

A flow rate decrease to a value less than Qr for a time at least greater than Tr2 allows to come back to the beginning of the cycle, either to actuate equipment 2 as shown in FIGS. 5, 5A, 5B and 5C, or to establish the drilling flow rate without actuating as described at the cycle beginning.

The point of origin of the diagrams of FIGS. 5, 5A, 5B and 5C corresponds to a circulation in the pipe at a zero flow rate or at a flow rate at least less than Qr. This circulation is effective for a time at least greater than Tr2, so that the operator is assured that the two adjusting devices are in the maximum sealing position.

A flow rate increase at least greater than Qr but less than Qa, for a time t2−t1 greater than Tf1 but less than Tf2, allows equipment 1 to be passed over to the adjustment O while equipment 2 keeps the adjustment F. By increasing thereafter the flow rate at least up to the flow rate Qa, the operator actuates equipment 2 without actuating equipment 1. Of course, the time t3−t1 for establishing the flow rate Qr, then Qa, must not be greater than Tf2, or the adjustment of equipment 2 would pass over to O.

The flow rate Qa may then be maintained for a time greater than Tf2 to set the seal means to the O position, so as to be able to establish directly the drilling flow rate Qf.

The examples described above are in no way limitative of the invention. Particularly, the activation flow rate Qa might not be identical for each equipment. Moreover, the curves showing the evolutions of the adjustments as a function of the flow rate might not be linear, as shown in the figures for the purpose of simplification.

I claim:

1. A device for remotely actuating equipment through a variation of flow conditions in a fluid flowing in a passageway of a pipe having a cross-sectional area, comprising:

coupling means between said device and said equipment to be actuated, adjusting means for varying the cross-sectional area of the passageway through which the fluid flows between a small and a large cross-sectional area as determined by the hydrodynamic action of the flow of said fluid in said pipe, wherein said adjusting means includes biasing means for repositioning a centralizing needle in a fixed annular flow bean and time delay means for controlling the time to go from the smaller area to the larger area;

means for preventing actuation of the equipment for a predetermined flow condition when the adjusting means are set to the smaller area; and means for preventing actuation of the equipment when the adjusting means are set for the larger area and the flow conditions have not changed.

2. A device as claimed in claim 1, wherein said adjusting means includes return means for adjusting the cross-sectional area of said passageway to a minimum value when the flow rate is substantially less than a predetermined flow rate Qr.

3. A device as claimed in claim 2, wherein said time delay means includes a hydraulic circuit and a flow regulator.

4. A device as claimed in claim 3, wherein the value of the flow rate controlled by said flow regulator is adjustable.

5. A device as claimed in claim 3, wherein said adjusting means includes a sliding element slidably mounted in the pipe.

6. A device as claimed in claim 5, wherein said sliding element co-operates with a hydraulic system comprised of two sealed chambers and wherein sliding of said slidable element is adapted for transferring the fluid contained in said system from one chamber to the other through said flow regulator.

7. A device as claimed in claim 6, wherein said adjusting means further includes a choke element co-operating with the coupling means, and wherein said sliding element is configured as a needle.

8. A method for remotely actuating equipment through variation of the conditions of a fluid in a pipe, said pipe comprising means for adjusting a cross-sectional area of a passageway in the pipe between a first cross-sectional area and a second cross-sectional area biasing means for repositioning a centralizing needle in a fixed annular flow bean, said adjusting means changing from the first cross-sectional area to the second through hydrodynamic action of flow generated by a flow rate at least equal to a flow rate value Qr and said adjusting means changing from the second cross-sectional area to the first cross-sectional area for a flow rate less than Qr; the method comprising the following steps:

selecting a time Tf with a time delay means during which said cross-sectional area adjusting means maintains said first cross-sectional area under the hydrodynamic action of a flow rate at least equal to Qr, selecting a time Tr with the time delay means during which said adjusting means maintains said second cross-sectional area under the hydrodynamic action of a flow rate less than Qr including a zero flow rate, and actuating the equipment while the adjusting means have set the cross-sectional area as the first cross-sectional area when Qa is greater than Qr.

9. A method as claimed in claim 8, wherein a flow is achieved at a flow rate less than the flow rate Qr for a time at least equal to Tr, wherein said equipment is actuated by performing a flow variation in the pipe up to a flow rate greater than an activation flow rate Qa greater than Qr, said variation being achieved for a time less than or equal to Tf.

10. A method as claimed in claim 8, further including the following step:

flowing the fluid at a flow rate at least equal to Qr for a time at least equal to Tf and thereafter increasing the circulation rate.

11. A method as claimed in claim 8, wherein said pipe includes first and second equipment components to be actuated each associated with adjusting means, wherein said flow adjusting means having times Tf1 and Tf2 as first adjustment maintenance times and Tr1 and Tr2 as second adjustment maintenance times, wherein Tf1 is less than Tf2, Tr1 is less than Tr2, and wherein the method comprises the following steps:

a) performing a circulation at a flow rate at least greater than Qr for a time greater than Tf2 so as to obtain the second adjustment, b) performing a circulation at a zero flow rate or at a flow rate less than Qr for a time greater than Tr2 so as to obtain the first adjustment.

12. A method as claimed in claim 11, comprising at least one of the following steps:

establishing a drilling flow rate Qf greater than an activation flow rate Qa without actuating said first and second equipment components, by carrying out step a) and thereafter by increasing the flow rate up to Qf, actuating the first equipment component without actuating equipment component, by carrying out successively step a), then by decreasing the flow rate to a value less than Qr for a time greater than Tr1 but less than Tr2 and thereafter by increasing the flow rate up to a flow rate greater than Qa, and actuating the second equipment component without actuating the first equipment component, by carrying out successively step b), then by increasing the flow rate up to a value at least equal to Qr for a time greater than Tf1 but less than Tf2 and then by increasing the flow rate up to a value greater than Qa.

13. A device as claimed in claim 1, wherein the equipment is integrated in a drill string and wherein the equipment includes a remote-controlled variable-geometry stabilizer and a remote-controlled variable-angle bend for allowing the trajectory of a wellbore to be controlled.

* * * * *